US008672123B1

(12) United States Patent
Vallejo et al.

(10) Patent No.: US 8,672,123 B1
(45) Date of Patent: Mar. 18, 2014

(54) DRY AND WET MIXING BABY BOTTLE

(71) Applicants: Mario Vallejo, Weston, FL (US); Juliana High-Vallejo, Weston, FL (US)

(72) Inventors: Mario Vallejo, Weston, FL (US); Juliana High-Vallejo, Weston, FL (US)

( * ) Notice: Subject to any disclaimer, the term of this patent is extended or adjusted under 35 U.S.C. 154(b) by 0 days.

(21) Appl. No.: 13/736,930

(22) Filed: Jan. 8, 2013

(51) Int. Cl.
*B65D 25/08* (2006.01)

(52) U.S. Cl.
USPC ..... 206/219; 206/221; 215/DIG. 8; 215/313; 222/153.01; 222/129; 222/153.04

(58) Field of Classification Search
CPC ..... B65D 1/00; B65D 27/00; B65D 39/00; A61K 6/00
USPC ..... 206/219, 221; 215/DIG. 8, 6
See application file for complete search history.

(56) References Cited

U.S. PATENT DOCUMENTS

| | | | | |
|---|---|---|---|---|
| 2,527,991 | A | 10/1950 | Greenberg | |
| 3,856,138 | A | 12/1974 | Maekawa | |
| 3,924,741 | A | 12/1975 | Kachur | |
| 4,779,722 | A | 10/1988 | Hall | |
| 5,564,600 | A | 10/1996 | Renault | |
| 5,678,709 | A | 10/1997 | Holley | |
| 6,045,254 | A | 4/2000 | Inbar | |
| 6,089,389 | A | 7/2000 | Sharon | |
| 6,113,257 | A | 9/2000 | Sharon | |
| 6,945,393 | B2 * | 9/2005 | Cho | 206/219 |
| 7,172,095 | B2 | 2/2007 | Marshall | |
| 7,331,478 | B2 * | 2/2008 | Aljadi | 215/11.4 |
| 7,828,139 | B2 | 11/2010 | Enghard | |
| 7,866,183 | B2 | 1/2011 | Roth | |
| 8,151,985 | B2 | 4/2012 | Owoc | |
| 8,292,099 | B1 * | 10/2012 | Wahlstrom | 215/6 |
| 8,453,834 | B2 * | 6/2013 | Porter | 206/222 |
| 2009/0301905 | A1 | 12/2009 | Bullard | |

FOREIGN PATENT DOCUMENTS

| | | |
|---|---|---|
| GB | 2462838 | 2/2010 |

* cited by examiner

*Primary Examiner* — J. Gregory Pickett
*Assistant Examiner* — Raven Collins
(74) *Attorney, Agent, or Firm* — Christopher J. Vandam, PA; Chris Vandam

(57) ABSTRACT

A baby bottle comprised of an upper assembly, a lower assembly and a baffle assembly. The upper assembly is adapted to contain separately a wet ingredient and a lower assembly is adapted to contain a dry ingredient. The baffle assembly includes an integral plug and aperture that rotates relative to the upper assembly so that the upper assembly is selectively in fluid communication with lower assembly to mix the wet and dry ingredients.

5 Claims, 4 Drawing Sheets

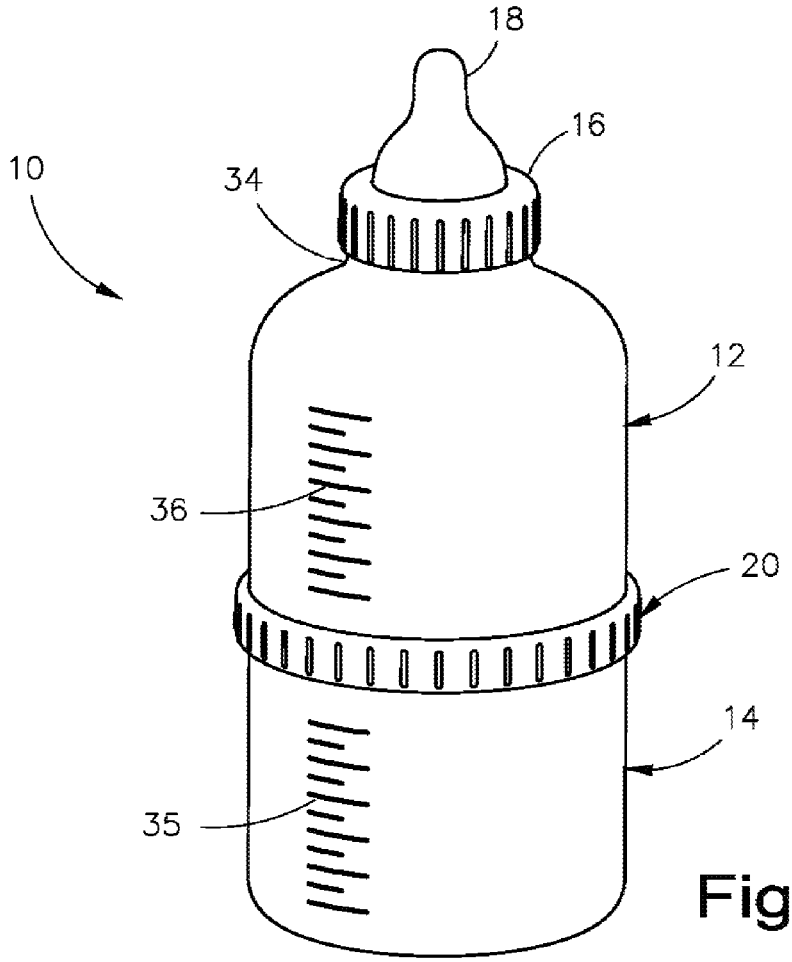
Fig. 1
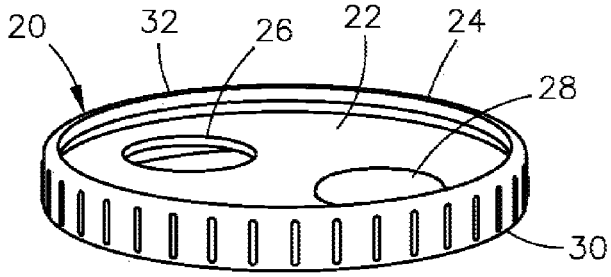
Fig. 2
Fig. 2A
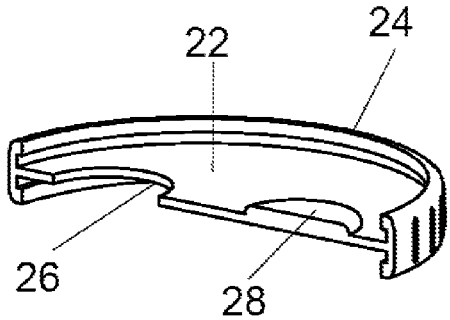

DRY AND WET MIXING BABY BOTTLE

BACKGROUND OF THE INVENTION

1. Field of the Invention

The present invention relates to baby feeding bottles, and more particularly, to a baby bottle that combines wet and dry ingredients prior to feeding a baby. The device can equally be used for other powdered drink mixes, for example, protein drinks or sports drinks.

2. Description of the Related Art

Several designs for baby bottles have been designed in the past. None of them, however, includes a central baffle assembly that friction fits into an upper assembly on a first side and a lower assembly on a second side and where a rotation of the upper assembly relative to the baffle selectively opens and closes fluid communication between the upper assembly and lower assembly.

Applicant believes that the closest reference corresponds to U.S. Pat. No. 8,151,985 issued to Owoc. However, it differs from the present invention because the present invention requires three principal components and no threaded inserts. This allows the present invention to be constructed with a minimal amount of machining and simple assembly while allowing the device to be easily cleaned, stored, assembled and operated.

Other patents describing the closest subject matter provide for a number of more or less complicated, features that fail to solve the problem in an efficient and economical way. None of these patents suggest the novel features of the present invention,

SUMMARY OF THE INVENTION

It is one of the main objects of the present invention to provide a baby feeding device that mixes a liquid food component and a powdered food component on demand.

It is another object of this invention to provide a feeding device that preserves the freshness and consistency of baby formulas, protein drinks, sports drinks and other similar liquid diets.

It is still another object of the present invention to provide a baby bottle that does not leak and is easy to clean.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents a perspective view of a version of the device as may be assembled and ready for use.

FIG. 2 shows a perspective view of a version of a baffle assembly separated from the other elements of the device.

FIG. 2A is a perspective view of a partial cross-section of the baffle assembly as shown in FIG. 2.

DETAILED DESCRIPTION OF THE PREFERRED EMBODIMENT

Figure 3:
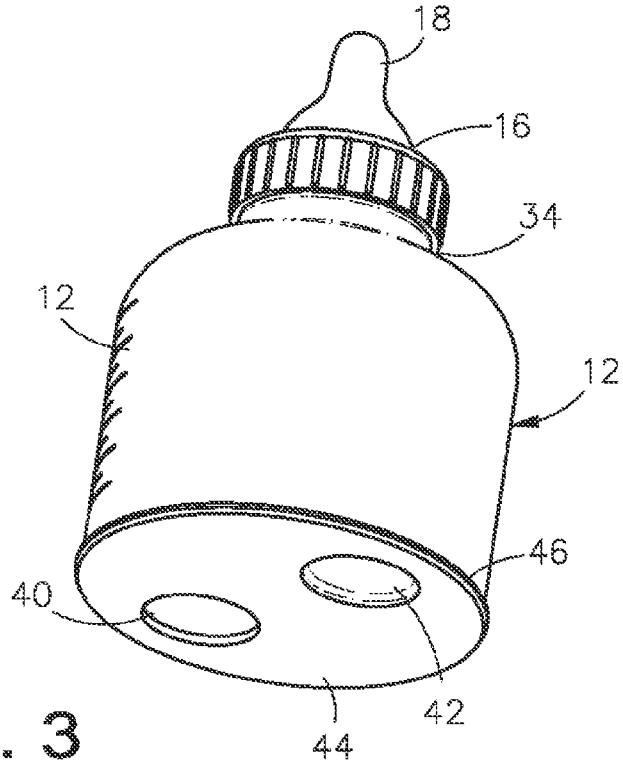
FIG. 3 illustrates a perspective view of an upper assembly showing a bottom surface in more detail.
Figure 5:
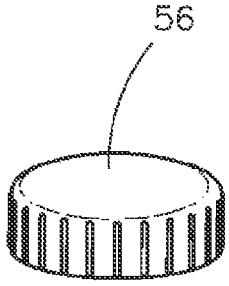
FIG. 5 is a perspective view of a cap.
Figure 4:
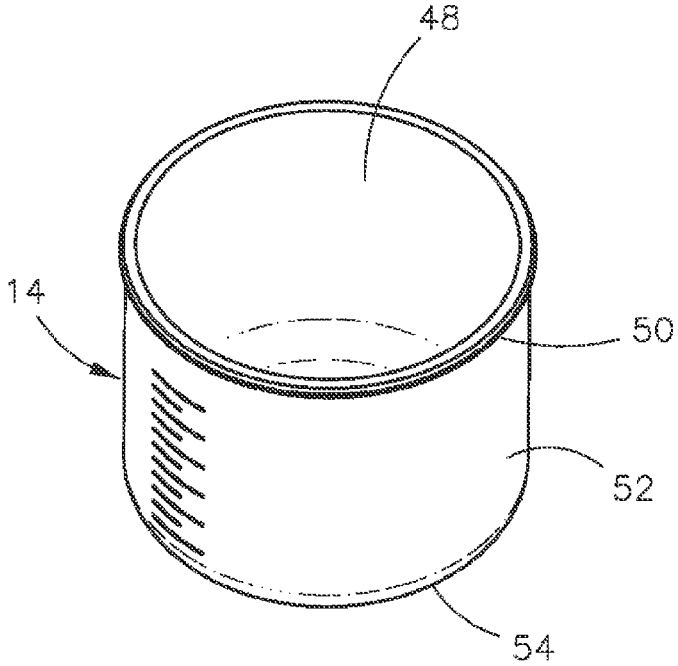
FIG. 4 is a representation of a perspective view of a lower assembly showing an interior in more detail.
Figure 6:
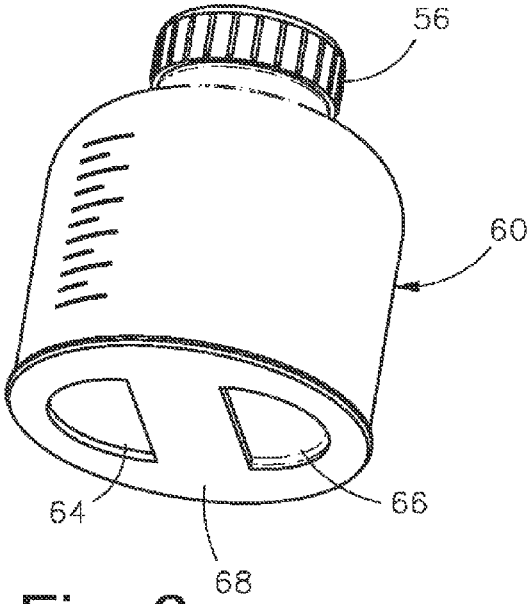
FIG. 6 is a perspective view of a version of an upper assembly showing a bottom side in more detail.
Figure 7:
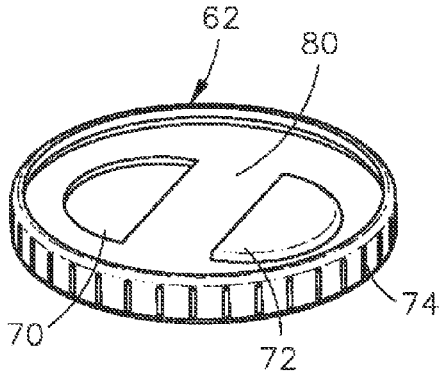
FIG. 7 is a perspective view of a baffle assembly that corresponds to the version of the device shown in FIG. 6.
Figure 8:
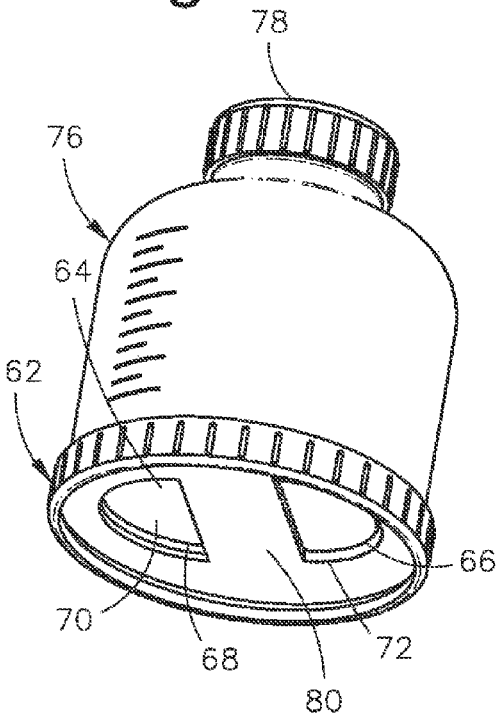
FIG. 8 is a perspective view of an upper assembly joined with a corresponding baffle assembly demonstrating an open fluid communication mode.
Figure 9:
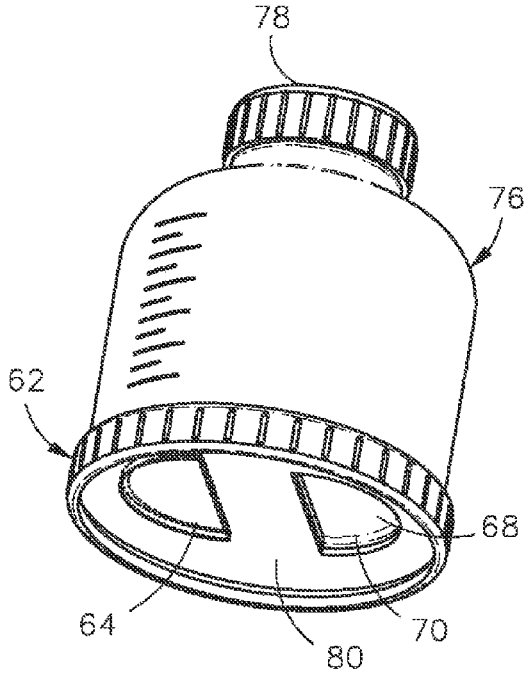
FIG. 9 is a perspective view of an upper assembly joined with a corresponding baffle assembly demonstrating a closed fluid communication mode.
Figure 10:
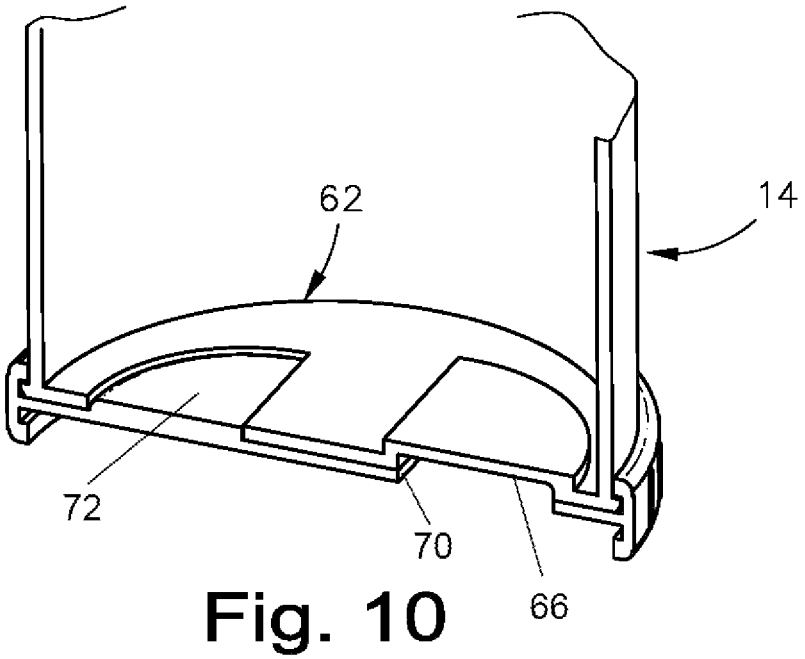
FIG. 10 is a perspective partial cross section view of the mode as shown in FIG. 9.
Figure 11:
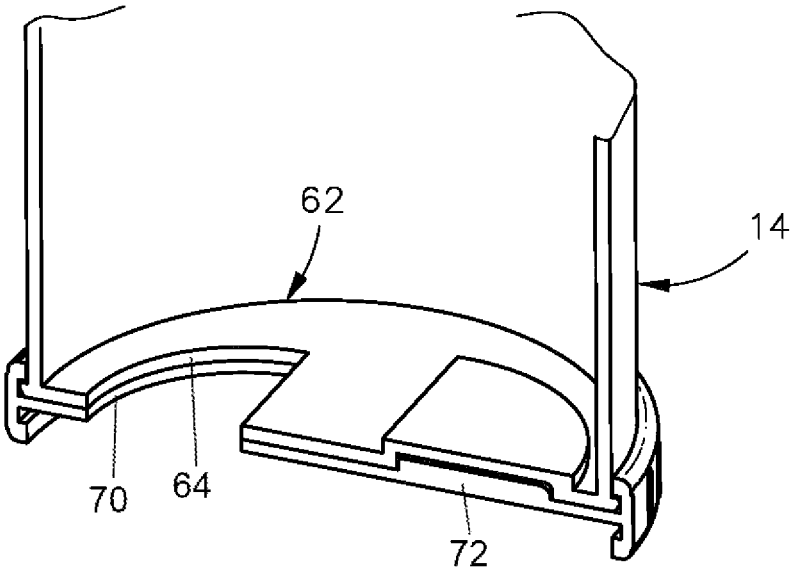
FIG. 11 is a perspective partial cross section view of the mode as shown in FIG. 8.

Parents frequently feed babies with a bottle while out of the home or simply for the added convenience over more traditional and manual feeding methods. Simple bottles containing milk or formula have been used for many years.

In more modern times there is an increased interest and availability of high quality powdered products that are combined and mixed with fluid immediately prior to consumption by the baby. Often these fluids are milk or water but other liquids containing medical treatment or nutritional supplements are also used.

To preserve the highest quality consistency, taste and smell it is sometimes preferred to have a limited time between reconstituting the powdered food with the appropriate liquid. This is often complicated for a parent on the move.

Today's parents or other child care providers are pressed for time and space as well as other constraints. It is frequently burdensome to measure, combine and mix a formula and liquid while also ensuring the safety and well-being of the child being cared for.

What is now needed is a way for parents to prepare a bottle for mixing at home without actually mixing the wet and dry ingredients at home. By being able to prepare the feeding device at the home, the later process of feeding is greatly simplified and made safer for both the parent and child.

Generally, with the present device the care-giver fills a lower assembly with the dry, powdered portion of the meal and then seals the lower assembly with a baffle assembly. An upper assembly is then filled with the appropriate volume of liquid. The entire device is thusly sealed and prepared for later use. When the care-giver decides to feed the baby they then rotate the top assembly relative to the baffle assembly which causes the dry ingredients to come into contact with the wet ingredients. The device is shaken to mix the dry and wet ingredients and the bottle is prepared for feeding.

Referring now to the drawings, where an important variation of the present invention is shown in figures one through five and is generally referred to with numeral 10. It can be observed that this version of the device basically includes an upper assembly 12, a lower assembly 14, a cap 16, a nipple 18, a baffle assembly 20, a septum 22, a ring 24, an aperture 26, a plug 28, a rim 30, a rim 32, a neck 34, graduations 35, graduations 36, a side 38, an aperture 40, a recess 42, a bottom 44, a lip 46, an interior 48, a lip 50, a side 52, a bottom 54 and a cap 56.

Figures six through eleven show a version of the device having several common and analogous elements, among other features, including an upper assembly 60, a baffle assembly 62, an aperture 64, a recess 66, a bottom 68, an aperture 70, a plug 72, a grip 74, an upper assembly 76, a cap 78 and a septum 80.

Referring again to figure one where a version of the assembled device is shown, generally the lower assembly 14 is friction fit or snapped onto the baffle assembly 20 to create a leak-proof seal between the lower assembly 14 and the baffle assembly 20.

Similarly and simultaneously, the upper assembly 12 is friction fit or snapped onto the baffle assembly 20 creating likewise a leak-proof seal between the upper assembly 12 and the baffle assembly 20. It is important that although the seal is leak-proof that the upper assembly 12 is able to rotate relative to the baffle assembly 20 while remaining leak-proof. This is achieved by the nature and construction of these elements, particularly the baffle assembly 20 having the ability to deform slightly while assembling and disassembling the device.

Practically, the baffle assembly 20 is made of a plastic that if rigid but has a predetermined degree of flexibility so that it can frictionally engage the upper assembly 12 and lower assembly 14. It is also possible that the baffle assembly 20 be constructed from a more rigid material such as a hard plastic, metal, glass or other similar material. In this case then the material of the upper assembly 12 and lower assembly 14 should be formed of a plastic with a limited ability to deform so that the upper assembly 12 and lower assembly 14 may deform during the assembly process when mating with a rigid baffle assembly 20.

Conversely and equally effective would be to construct the baffle assembly 20 from a slightly deformable plastic and make the upper assembly 12 and lower assembly 14 from an inflexible medium such as glass, rigid plastic, metal or other similar material. This combination of materials works because the rigid upper assembly 12 and rigid lower assembly 14 can mate and engage with a slightly softer and deformable baffle assembly 20 and yet combine to result in a leak proof seal between these three assemblies.

Similar to a traditional baby bottle, a cap 16 with an integral supple nipple 18 is provided. Just as in that traditional bottle, the nipple 18 is available to give the feeding baby a place to engage the bottle to extract the contents of the bottle. Preferably threads or other similar means connect the upper assembly 12 to the cap 16 and nipple 18 at the neck 34. Also preferably the cap 16 and nipple 18 are removable for maintenance, cleaning and filling.

Optional graduations 36 on the side of the upper assembly 12 and/or the graduations 35 on the lower assembly 14 are provided to aid in both the filling of the device and to determine the volume of contents that have been consumed by the feeding child.

Fabricating the upper assembly 12 and lower assembly 14 of a transparent or translucent material will increase the functionality of the graduations 35 and graduations 36. Being able to visually observe the volume and contents of the device is also preferred and accomplished by a translucent or transparent nature of the upper assembly 12 and the lower assembly 14.

Now referring to figures two and two-A, a version of the baffle assembly 20 is shown in more detail. The baffle assembly 20 generally requires at least one aperture 26. It is through this aperture that the liquid in the device passes into contact with the powdered contents at the time of mixing.

The plug 28 is provided on the surface of the septum 22. The plug 28 in a preferred version may be fairly characterized as a raised element. The plug 28 is dimensioned and adapted to selectively fit into and seal off aperture 40 (shown in figure three) on the upper assembly 12 when the baffle assembly 20 and upper assembly 12 are aligned when the device is in a storage mode.

Generally, the device is operated between a storage mode and a mixing mode by rotating the baffle assembly 20 relative to the upper assembly 12. The upper assembly 12 and baffle assembly 20 are leak-proof once frictionally engaged with each other but retain the ability to rotate relative to each other.

To be in the storage mode the plug 28 in the baffle assembly 20 must be engaged into the aperture 40 of the upper assembly 12. This engagement occurs by rotating the upper assembly 12 relative to the baffle assembly 20. The location of the plug 28 is carefully positioned on the baffle assembly so that when the aperture 40 and plug 28 are aligned, they engage to create a leak-proof seal.

Conversely, to be in the mixing mode the aperture 26 in the baffle assembly 20 is lined up to be concentric with the aperture 40 in the upper assembly 12. When the aperture 26 and aperture 40 are in line then any liquid contained in the upper assembly 12 is then in liquid communication with the lower assembly 14. The fluid in the upper assembly 12 may then flow with aid of gravity into the lower assembly 14 which typically contains the dry elements of the formula.

Once the liquid from the upper assembly 12 pours into the lower assembly containing the powder, the entire device is shaken to mix the wet and dry and create a homogenous formula that can be readily consumed by the child. Optionally, an agitator device may be added inside the lower assembly 14 to hasten the mixing. The agitator may be simply a small ball or have some defined shape to help break up the dry ingredients as they are mixed with the wet.

Figure three shows a perspective view of the upper assembly 12 exposing the bottom 44. Integral to the bottom 44 are the aperture 40 and the recess 42. As described above, the aperture 40 lines up with the aperture 26 in to put the upper assembly 12 and lower assembly 14 in fluid communication with each other during mixing.

The recess 42 does not penetrate the bottom 44. The recess 42 in the bottom 44 of the upper assembly 12 is a depression or divot that the plug 28 nests into when in mixing mode. When the plug 28 is in the recess 42 the aperture 26 and aperture 40 are necessarily aligned. The engagement of the plug 28 into the recess 42 can also provide the user a tactile indication that the device is configured into it mixing mode when the user feels these elements coincide.

The lip 46 on the edge of the bottom 44 encircles the lower edge of the upper assembly 12. This lip 46 aids in positively snapping the upper assembly 12 into the baffle assembly 20. A corresponding groove in the interior of the rim 32 mates with the lip 46. When the device is shifted from storage mode into mixing mode the lip 46 rides in the rim 32 groove and the liquid-tight seal is maintained so that there are no leaks regardless of the relative rotation of the upper assembly 12 relative to the baffle assembly 20.

Figure four is a perspective view of an example of a lower assembly 14 apart from the other components that comprise the device. The lower assembly 14 has an interior 48 where the dry ingredients would typically be held prior to mixing with the wet ingredients.

The lip 50 on the lower assembly 14 is analogous to the lip 46 on the upper assembly and both perform a similar function. The lip 50 in the lower assembly 14 snaps into a groove the rim 30 in the baffle assembly. This permits rotation of the lower assembly 14 relative to the baffle assembly while maintaining a liquid tight seal between the lower assembly and the baffle assembly 20.

It should be apparent that although the baffle assembly 20 may rotate relative to the lower assembly 14 there is no reason for this movement. This is because the top of the lower assembly 14 is open to the interior 48. There are no features on the lower assembly 14 that correspond to the bottom 44 and aperture 40 that are on the upper assembly 12.

Figure five shows a perspective view of a cap 56. The cap 56 is adapted to thread onto the threads on the neck 34 as a replacement for the nipple 18 and cap 16. The cap 56 may include a gasket on the underside to improve the seal against the neck 34. The cap 56 may be used during transport or storage of the device to avoid leakage that may occur with the nipple 18 alone.

Figures six through eleven are provided to show a variation in the shapes of the bottom 68, aperture 64 and recess 66 on this upper assembly 60. The baffle assembly 62 has a corresponding geometry of the aperture 70, plug 72 and septum 80. The functionality of this version shown in figures six through eleven is materially identical to that as shown in figures one through five.

It should be notes that the bottom assembly 14 as demonstrated in figure four might not change in shape when used with the upper assembly 60 and baffle assembly 62. This is because the interaction between the upper assembly 60 and baffle assembly 62 when shifting the device from a storage or transport mode to a mixing mode does not involve the geometry of the lower assembly 14.

Figures eight and eleven show the device in a mixing mode. The aperture 64 and aperture 70 are aligned to allow fluid communication between the upper assembly 60 and lower assembly 14. Notice that the plug 72 is engaged into the recess 66. The plug 72 fitting into the recess frictionally keeps the baffle assembly 62 relative to the upper assembly 60 and also provides a specific feel to the user when the plug 72 snaps into the recess indicating that the aperture 64 and aperture 70 are aligned and in mixing mode.

Figures nine and ten show the device in a storage or transport mode. In this configuration the aperture 64 in the upper assembly 60 is sealed with the plug 72 thereby sealing liquid in the upper assembly 60 tightly. The engagement of the plug 72 into the aperture 64 provides a tactile positive indication that the transport mode has been achieved. The sealed storage or transport mode may also be verified visually by seeing the bottom 68 of the upper assembly 60 through the aperture 70 in the baffle assembly 62.

To switch between the mixing mode and the storage or transport mode the user grasps the upper assembly 60 with one hand the baffle assembly 62 with the other hand and rotates one relative to the other. At about one hundred eighty degrees of difference between the mixing and storage mode, each mode is readily achieved and verified. Grips 74 are optionally provided to enhance the user's grip on to the device when changing modes.

Another important use of the basic principles of the device include for adult use in sports or nutritional beverages. In this variety the upper assembly and lower assembly remain essentially the sane and the nipple is absent. The cap 56 as shown in figure five is sufficient for non-baby uses. Another resealable cap may equally be used as is employed in many other water and sports drink bottles.

Often these sport drinks take the form of a protein powder that mixes with milk, water or some other liquid. A wide variety of dry or powdered products intended to be combined with a liquid prior to consumption may be used effectively with this device.

An important version of the invention can be fairly described as a baby bottle comprising an upper assembly, a lower assembly and a baffle assembly. The upper assembly and said lower assembly are generally cylindrical and have substantially the same diameter. Up to about a ten percent difference in diameter between the upper and lower assembly is typically acceptable. The lower assembly has a first end and second end where said second end is closed and said first end is open. Essentially the lower assembly is shaped similar to an open top cup. The lower assembly has a lip on an exterior surface around said first end to help it engage into the baffle assembly. The upper assembly has a first end and a second end where said second end has a threaded neck and said first end is partially closed by a bottom. There are openings in the first end that are operably plugged by the baffle assembly when rotated into alignment. The first end of the upper assembly includes an aperture and a recess. When the aperture in the upper assembly and aperture in the baffle assembly are aligned then the upper assembly and lower assembly are in fluid communication. The baffle assembly has a round septum with substantially the same diameter as the upper assembly and the septum is encircled with an integral ring. The ring has a first rim on an interior first side and a second rim on an interior second side. These rims engage frictionally yet permit relative rotation to the respective upper assembly and lower assembly. The septum has an aperture dimensioned similar to said aperture on said first end of the upper assembly so that when aligned they engage one another. The septum has a plug dimensioned similar to said aperture on said first end of said upper assembly so that when aligned it can seal the upper assembly. The first end of said upper assembly is dimensioned to frictionally and rotatably engage into said first rim on said baffle assembly forming a leak proof seal. The first end of said lower assembly is dimensioned to frictionally engage into said second rim on said baffle assembly forming a leak proof seal. During use a nipple with threads is attached to said thread on the neck. This nipple can be substituted for a simple cap.

Optional elements of this design can be characterized in that the aperture in said first end of said upper assembly is semicircular in shape. In fact almost any shape may work as long as the apertures are similar in shape to the plugs so that the apertures can be selectively opened and closed. Also optional are visible graduations on the upper or lower assembly to help the user measure the appropriate amount of material in the upper and lower assemblies. Grips on an exterior surface of said ring can help the user rotate the parts to open and close the device from mixing to storage mode and back again.

The foregoing description conveys the best understanding of the Objectives and advantages of the present invention. Different embodiments may be made of the inventive concept of this invention. It is to be understood that all matter disclosed herein is to be interpreted merely as illustrative, and not in a limiting sense.

What is claimed is:

1. A baby bottle comprising an upper assembly, a lower assembly and a baffle assembly;

the upper assembly, lower assembly and baffle assembly each individually have no moving parts;

said upper assembly and said lower assembly are cylindrical and have substantially the same diameter;

said lower assembly has a first end and second end where said second end is closed and said first end is open;

said lower assembly has a lip on an exterior surface around said first end;

said upper assembly has a first end and a second end where said second end has a threaded neck and said first end is partially closed by a bottom;

said first end of the upper assembly includes an aperture and a recess;

said baffle assembly has a round septum with substantially the same diameter as the upper assembly;

said septum is encircled with an integral ring;

said ring has a first rim on an interior first side and a second rim on an interior second side;

said septum has an aperture dimensioned similar to said aperture on said first end of the upper assembly;

said septum has a plug dimensioned similar to said aperture on said first end of said upper assembly;

the upper assembly is operatively sealed apart from the lower assembly when the baffle assembly is rotated relative to the upper assembly so that the plug seals the aperture on the first end of the upper assembly;

said first end of said upper assembly is dimensioned to frictionally engage without threads into said first rim on said baffle assembly forming a leak proof seal that allows the upper assembly to rotate relative to the baffle assembly in either a clockwise or a counter-clockwise direction while remaining leak proof;

said first end of said lower assembly is dimensioned to frictionally engage into said second rim on said baffle assembly forming a leak proof seal;

a nipple with threads is attached to said thread on the neck;

said upper assembly can be operatively in fluid communication with the lower assembly when the baffle assembly is rotated relative to the upper assembly so that the aperture in the upper assembly is aligned with the aperture on the septum assembly and while in fluid communication the plug is engaged into the recess on the first end of the upper assembly to maintain alignment of the aperture on the upper assembly and baffle.

2. A baby bottle such as disclosed in claim 1 further characterized in that said aperture in said first end of said upper assembly is semicircular in shape.

3. A baby bottle such as disclosed in claim 1 further characterized in that said upper assembly has visible graduations.

4. A baby bottle such as disclosed in claim 1 further characterized in that said baffle assembly further includes grips on an exterior surface of said ring.

5. A beverage bottle comprising an upper assembly, a lower assembly and a baffle assembly;

the upper assembly, lower assembly and baffle assembly each individually have no moving parts;

said upper assembly and said lower assembly are cylindrical and have substantially the same diameter;

said lower assembly has a first end and second end where said second end is closed and said first end is open;

said lower assembly has a lip on an exterior surface at said first end;

said upper assembly has a first end and a second end where said second end has a threaded neck and said first end is partially closed by a bottom;

said first end of the upper assembly includes an aperture and a recess;

said baffle assembly has a round septum with substantially the same diameter dimension as the upper assembly;

said septum is encircled with an integral ring;

said ring has a first rim on a first interior side and a second rim on a second interior side;

said septum has an aperture dimensioned similar to said aperture on said first end of the upper assembly;

said septum has a plug dimensioned similar to said aperture on said first end of said upper assembly;

the upper assembly is operatively sealed apart from the lower assembly when the baffle assembly is rotated relative to the upper assembly so that the plug seals the aperture on the first end of the upper assembly;

said first end of said upper assembly is dimensioned to frictionally engage without threads into said first rim on said baffle assembly forming a leak proof seal that allows the upper assembly to rotate relative to the baffle assembly in either a clockwise or a counter-clockwise direction while remaining leak proof;

said first end of said lower assembly is dimensioned to frictionally engage into said second rim on said baffle assembly forming a leak proof seal;

a cap with threads is attached to said thread on the neck;

said upper assembly can be operatively in fluid communication with the lower assembly when the baffle assembly is rotated relative to the upper assembly so that the aperture in the upper assembly is aligned with the aperture on the septum assembly and while in fluid communication the plug is engaged into the recess on the first end of the upper assembly to maintain alignment of the aperture on the upper assembly and baffle.

* * * * *